United States Patent [19]

Harvey

[11] Patent Number: 5,045,980

[45] Date of Patent: Sep. 3, 1991

[54] FLASHLIGHT ADAPTER

[75] Inventor: Richard T. Harvey, Roswell, Ga.

[73] Assignee: Roy Anderson, Fort Worth, Tex.

[21] Appl. No.: 506,479

[22] Filed: Apr. 9, 1990

[51] Int. Cl.[5] ..... F21L 7/00

[52] U.S. Cl. ..... 362/202; 362/255; 362/277

[58] Field of Search ..... 362/200-209, 362/139, 283, 281, 277, 306, 341, 255

[56] References Cited

U.S. PATENT DOCUMENTS

| | | | |
|---|---|---|---|
| 1,274,713 | 8/1918 | Hoffmann et al. | 362/200 |
| 1,967,140 | 7/1934 | Ainslie | 362/255 |
| 2,119,486 | 5/1938 | Muldoon | 362/202 |
| 2,137,881 | 11/1938 | Margulies | 362/202 |
| 2,616,030 | 10/1952 | Van Dyke | 362/255 |
| 2,623,989 | 12/1952 | Lehmann | 362/255 |
| 4,521,834 | 6/1985 | Orr | 362/202 |

*Primary Examiner*—James C. Yeung

*Attorney, Agent, or Firm*—James E. Bradley

[57] ABSTRACT

An adapter is shown for a flashlight of the type having a body which contains a light generating source for emitting a light beam, a reflector element, and an associated lens through which the reflected light beams pass along a longitudinal axis generally parallel to the longitudinal axis of the flashlight body. The adapter includes an outer flange having an exterior and an interior reflecting surface. A centrally located aperture is provided in the outer flange. A mounting member attaches the adapter to the flashlight body and holds the outer flange inclined to the longitudinal axis of the emitted light, whereby a portion of the emitted light passes through the aperture in the outer flange and a portion of the emitted light is deflected at an angle.

8 Claims, 1 Drawing Sheet

FLASHLIGHT ADAPTER

BACKGROUND OF THE INVENTION

1. Field of the Invention

This invention relates to improvements to light emitting devices and more particularly to a reflective adapter that may be used in combination with fixed or portable light emitting devices. 2. Prior Art A particular concern with many light emitting devices is the directivity of the emitted light beam. In many applications, a mechanism is needed for concentrating the emitted light into one or more directions in a manner sufficient to provide optimal dispersion of the total light emission while retaining sufficient illumination in appropriate areas. Of particular concern with portable light emitting devices, such as flashlights, is the enhancement to safety which results from the ability to view nearby objects while at the same time illuminating an area at a greater distance.

Two common examples of this problem are:

1) The user of a flashlight, while walking along a darkened path, cannot illuminate the path immediately in front of his feet to avoid obstacles to his next step while simultaneously illuminating the path further in front of his feet to illuminate obstructions which could be avoided if anticipated sufficiently in advance;
2) The user of a flashlight, while ascending a darkened staircase, must choose between illuminating the step immediately next in front of the step on which he stands and the steps more nearly in line with his eye level.

Of particular concern with both fixed and portable light emitting devices is the ability to illuminate a narrowly constricted channel, such as a pipe, from its end while simultaneously viewing the illuminated channel. An example of this problem emerges when a user of an ordinary single beam flashlight, while shining its beam into the end of a small diameter pipe, tries to peer around the obstruction to his view caused by the flashlight itself when held between his eye and the pipe opening.

Known prior art solutions to these problems have included reflecting and refracting devices which redirect the emitted light along a different path from its original emission direction to concentrate its lumen output. To my knowledge, none of the prior art devices have divided the beam into two or more directed beams for illuminating two or more non-juxtaposed areas simultaneously. Further, none have provided an adapter with a reflecting surface for redirecting the emitted light, the adapter having an aperture through the reflecting surface for line of sight view along the axis of the redirected light to permit non-parallax views of the objects or areas illuminated by the redirected light.

Therefore, it is an object of this invention to provide a means of splitting the beam of light emitted by a flashlight along a first axis into two or more light beams having beam axes at an angle to each other for purposes of lighting two or more areas simultaneously.

Another object of this invention is to provide an adapter for a flashlight to redirect a portion of its light at an angle to the original axis of light transmission while permitting the remainder of the light to continue undisturbed along its original path.

Another object of this invention is to provide an adapter for a flashlight body to direct light into a narrow channel, the adapter having an aperture through which the narrow channel may be viewed unobstructed by the flashlight body.

Still other objects and advantages of this invention shall become apparent from consideration of the drawings and the ensuing description thereof.

SUMMARY OF THE INVENTION

The flashlight adapter of the invention is used with a conventional flashlight of the type having a body containing a light source for emitting light, a reflector element for reflecting the emitted light outwardly, a lens through which the emitted light passes, and a globe for focusing the emitted light along a path generally parallel to the longitudinal axis of the flashlight body. The adapter of the invention has an outer flange having an exterior surface, an interior reflecting surface, and a centrally located aperture. Mounting means are provided for mounting the outer flange in the path of light emitted from the light source, whereby a portion of the emitted light passes through the aperture in the outer flange and a portion of the light is deflected at an angle.

Preferably, the mounting means is a semicylindrical collar which extends parallel to the longitudinal axis of the flashlight body, the collar having a peripheral mounting flange which is received within the interior of the flashlight globe by unscrewing the threaded connection which exists between the globe and the lens end of the flashlight body.

DETAILED DESCRIPTION OF THE DRAWINGS

PREFERRED EMBODIMENTS OF THE INVENTION

Figure 1:
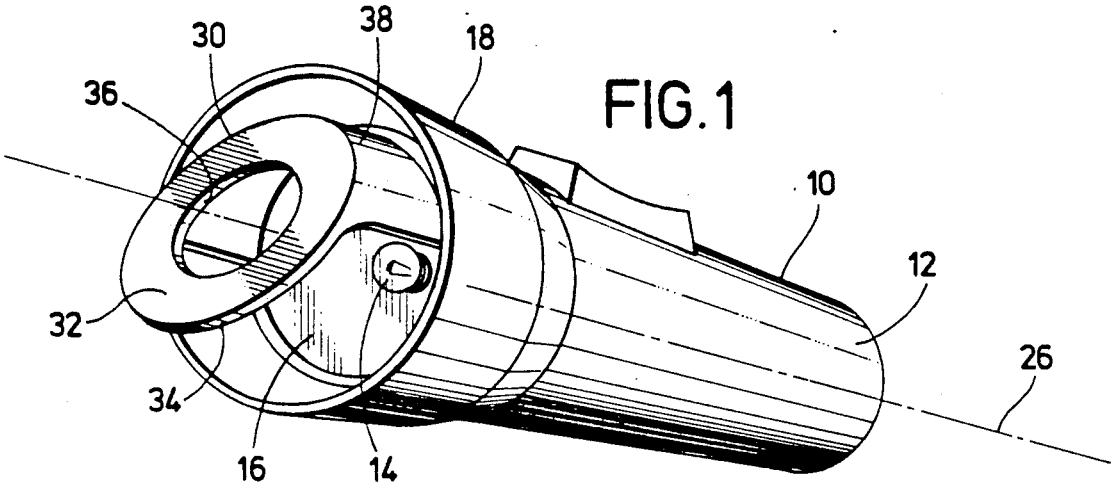
FIG. 1 is a perspective view of a flashlight with the adapter of the invention in place.

Turning to FIG. 1, a preferred embodiment of the flashlight adapter is illustrated installed on a flashlight 10. Although the invention is described in terms of a "flashlight" other fixed or portable light emitting devices are intended to be encompassed as well, where the objects of the invention can be advantageously achieved. For instance, other lanterns, lamps, and the like having light generating sources and lenses can be improved through the use of the adapter of the invention.

Figure 2:
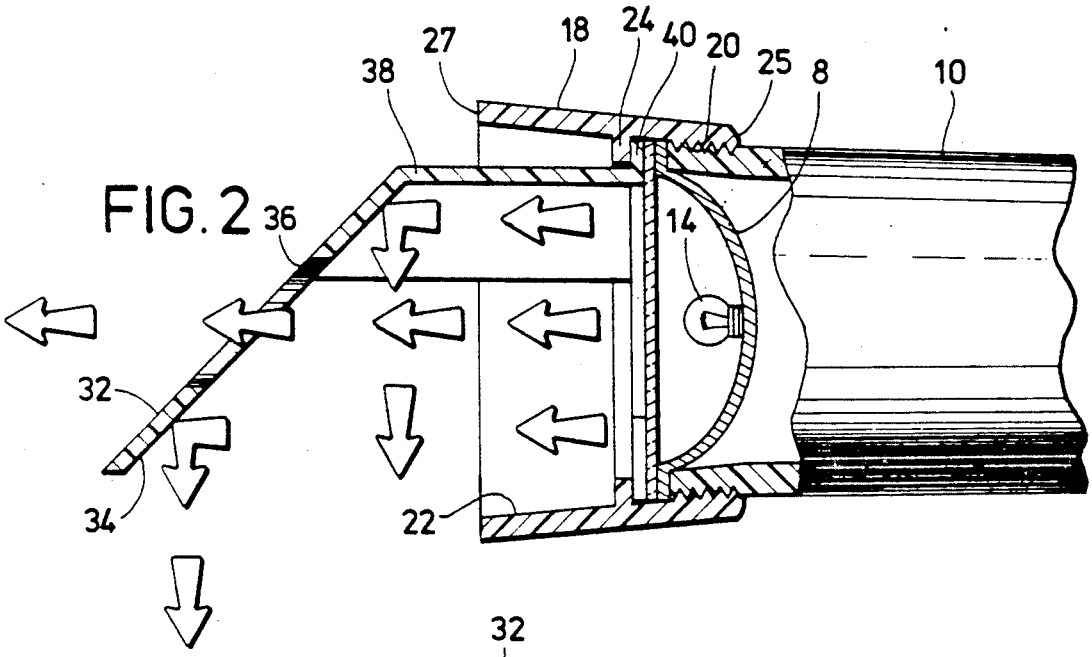
FIG. 2 is a cut-away side view of the lens end of the flashlight showing the invention in use and how it redirects a portion of the light emitted from the lens.

The flashlight 10 has a body 12 containing one or more conventional batteries for powering a light source, such as bulb 14. The flashlight 10 also has a concave reflector element 8 for reflecting light beams from the source 14 outwardly through a conventional lens 16. A generally cylindrical globe 18 is mounted about the lens end of the flashlight 10 by an internally threaded region 20 which engages the mating externally threaded region of the flashlight body. The globe 18 has an interior surface 22 which is tapered outwardly and also has an internal shoulder 24 which is normally intended to engage and retain lens 16. The internal shoulder 24 is located on the interior surface 22 approximately mid-way between an inner extent 25 and outer extent 27 of the globe 18. As shown in FIGS. 1 and 2, the light source 14 normally emits light beams generally parallel to the longitudinal axis 26 of the flashlight body 12.

The adapter 28 of the invention includes an outer flange 30 having an exterior surface 32 and an interior, inclined reflecting surface 34. A centrally located aperture 36 is provided in the outer flange 30 for receiving a portion of the light beams emitted from the light source 14. The adapter is mounted on the flashlight body by means of a semi-cylindrical collar 38 which is mounted concentric with the emitted light beams from the light source 14 by means of a horseshoe-shaped, peripheral mounting flange 40.

The peripheral mounting flange 40 is conveniently received beneath the internal shoulder 24 of the flashlight globe 18 by simply unscrewing the threaded connection 20. The outside diameter of the peripheral mounting flange 40 is sized to fit snugly within the internal diameter of the globe 18 beneath the shoulder 24. In this way, the adapter can be fitted to a conventional flashlight without the necessity of modifying the flashlight.

Figure 3:
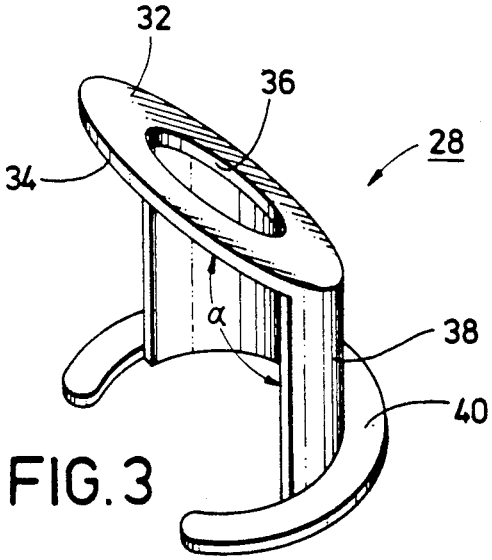
FIG. 3 is an isolated, perspective view of the adapter of the invention.

In the preferred embodiment of the invention, illustrated in FIGS. 2 and 3, the outer flange 30 forms an obtuse angle ($\alpha$ in FIG. 3) with respect to the collar 38 so that the outer flange 30 is inclined outwardly. The angle $\alpha$ in FIG. 3 is approximately 135 degrees. A portion of the light beams emitted from the source 14 are consequently directed downwardly at an angle to intersect the longitudinal axis 26. However, a portion of the beams continue to pass through the aperture 36 parallel or coincident to the longitudinal axis 26. Thus, portions of the light beams emitted from the source 14 intersect the interior, reflective surface 34 and are redirected at an angle away from the semi-cylindrical collar 38, while other portions of the beam continue through aperture 36 unobstructed, thereby splitting the beam of light, emitted from light source 14 and directed by reflector 8, into beams of light; one in the original direction of emission and the other at a predetermined angle thereto.

It will be understood that the fixed angle of the inclined, reflective surface 34 can be selected such that the angle of the redirected light is 90 degrees to the angle of the original longitudinal axis 26 so that a witness looking through aperture 36 in a direction perpendicular to the original emission axis can direct his sight along the redirected light 's second axis and look inside the light along the second axis through the aperture 36.

An invention has been provided with several advantages. The adapter of the invention is simple in design and economical to manufacture. It is easily adapted to a variety of existing flashlight designs. The adapter permits enhanced vision within constricted openings and other confined areas and allows a user to view a nearby area while at the same time illuminating an area at a greater distance. This invention overcomes the inability of a user of an ordinary flashlight to look into a constricted viewing port of a space while holding the flashlight at a proper angle to illuminate the space to be viewed.

These and other embodiments not specifically described are intended to be included in the scope of this invention as described by the following claims.

What I claim is:

1. An adapter for a flashlight, the flashlight having a body extending along a longitudinal axis and containing a light source for emitting light, a reflector element for reflecting emitted light outwardly through a lens end of the flashlight body, a lens through which the emitted light passes, and a removable hollow globe mounted at and concentric to the lens end for focusing the emitted light along a path generally parallel to the longitudinal axis of the flashlight body, the globe further having an internal shoulder for retaining the lens sandwiched between the internal shoulder and the flashlight body, the adapter comprising:

a mounting flange adapted to be sandwiched between the internal shoulder of the globe and the lens end for mounting the adapter to the flashlight while permitting the light to continue through the globe substantially unimpeded;

a collar connected to the mounting flange, extending outward through the globe of the flashlight and having an outer end adapted to be located outward of the globe; and an outer flange having a reflecting surface and a centrally located aperture and mounted by its reflecting surface to the outer end of the collar, the outer flange adapted to be mounted in the path of light emitted from the lens end and at an angle transverse to the longitudinal axis of the flashlight, wherein the longitudinal axis passes through the centrally located aperture, for permitting the reflecting surface to intercept and redirect a portion of the emitted light along and generally parallel to a second axis which passes through the centrally located aperture in the outer flange for permitting a user to view through the centrally located aperture and along the second axis an area illuminated by the redirected light.

2. The adapter of claim 1, wherein the collar is semi-cylindrical and wherein the angle at which the outer flange is mounted to the outer end of the collar is a fixed, obtuse, interior angle between a diametrical chord of the reflecting surface and a longitudinal axis of the collar, the angle being approximately 135 degrees.

3. The adapter of claim 1, wherein the collar has a longitudinal axis coincident with the aperture and wherein the mounting flange extends radially outward from the collar.

4. An improved flashlight comprising, in combination:

a flashlight body extending along a longitudinal axis and containing a light source for emitting light, a reflector element for reflecting the emitted light outwardly through a lens end of the flashlight body, a lens through which the emitted light passes, and a removable, hollow globe mounted at and concentric to the lens end for focusing the emitted light along a path generally parallel to the longitudinal axis of the flashlight body, the globe further having an internal shoulder for retaining the lens sandwiched between the internal shoulder and the flashlight body; and an adapter having a mounting flange sandwiched between the internal shoulder of the globe and the lens end, the adapter further having a collar, the collar having a mounting end and an outer end, the mounting end attached to the mounting flange so that the collar extends through the globe and generally parallel to the longitudinal axis, the adapter further having an outer flange, the outer flange having a reflecting surface and a centrally located aperture and being attached by the reflecting surface to the outer end of the collar, the outer flange being mounted in the path of light emitted from the lens end, whereby a portion of the emitted light passes through the aperture in the outer flange and a portion of the light is deflected at an angle by the reflecting surface along and generally parallel to a second axis which passes through the aperture.

5. The improved flashlight of claim 4, wherein the collar is semi-cylindrical and wherein the angle at which the outer flange is mounted to the outer end of the collar is fixed, obtuse, interior angle between a diametrical chord of the reflecting surface and a longitudinal axis of the collar, the angle being approximately 135 degrees.

6. The improved flashlight of claim 4, wherein the collar has a longitudinal axis coincident with the aperture and wherein the mounting flange extends radially outward from the collar.

7. The improved flashlight of claim 4, wherein a diametrical chord of the reflecting surface on the outer flange form one leg of an obtuse angle with respect to the longitudinal axis; the angle being fixed at approximately 135 degrees.

8. A method of viewing the interior of a space having a constricted viewing port comprising:

providing a flashlight having a flashlight body extending along a longitudinal axis and containing a light source for emitting light outwardly through a lens end of the flashlight body;

mounting on the flashlight body an adapter having an outer flange inclined relative to the longitudinal axis and mounted in the path of the emitted light, the outer flange having a reflecting surface and a centrally located aperture concentric to the longitudinal axis of the flashlight body, wherein a portion of the light is deflected at an angle by the reflecting surface along and generally parallel to a second axis which passes through the aperture;

turning on the flashlight to cause light to be emitted along the longitudinal axis and causing a portion thereof to be deflected along the second axis;

aligning the second axis into the constricted viewing port of the space to be viewed; and then viewing the interior of space through the aperture of the outer flange as illuminated by the deflected light.

* * * * *